US005902054A

United States Patent [19]

Coudray

[11] Patent Number: 5,902,054

[45] Date of Patent: May 11, 1999

[54] ENERGY SAVING IMAGE EDGING METHOD AND DEVICE

[75] Inventor: Pascal Coudray, La Chapelle des Fougeretz, France

[73] Assignee: Canon Kabushiki Kaisha, Tokyo, Japan

[21] Appl. No.: 08/789,868

[22] Filed: Jan. 28, 1997

[51] Int. Cl.[6] ..... B41J 2/36

[52] U.S. Cl. ..... 400/120.09; 347/192

[58] Field of Search ..... 400/54, 74, 120.07, 400/120.09, 120.1, 120.12, 88, 120 HH, 103, 104, 120.05; 347/183, 192

[56] References Cited

U.S. PATENT DOCUMENTS

| | | | |
|---|---|---|---|
| 4,113,391 | 9/1978 | Minowa | 347/192 |
| 4,407,003 | 9/1983 | Fukui | 346/76 PH |
| 4,528,572 | 7/1985 | Sasaki | 347/192 |
| 4,553,867 | 11/1985 | Nakai | 400/323 |
| 4,738,553 | 4/1988 | Uemura | 400/120.05 |
| 5,432,533 | 7/1995 | Shibamiya | 347/192 |
| 5,539,442 | 7/1996 | Hitoshi | 347/183 |
| 5,673,070 | 9/1997 | Nakanishi | 347/19 |

FOREIGN PATENT DOCUMENTS

| | | | |
|---|---|---|---|
| 0443245 | 2/1990 | European Pat. Off. | 347/19 |
| 0587385 | 3/1994 | European Pat. Off. | 347/19 |
| 0593282 | 4/1994 | European Pat. Off. | 347/19 |
| 0667240 | 8/1995 | European Pat. Off. | 347/19 |

OTHER PUBLICATIONS

Pat. Abs. Jp., vol. 011, No. 123 (M-581), Apr. 17, 1987 (JP-A-61 263783).

Pat. Abs. Jp., vol. 013, No. 327 (M-854), Jul. 24, 1989 (JP-A-01 140178).

Pat. Abs., Jp., vol. 013, No. 473 (M-884), Oct. 26, 1989 (JP-A-01 186354).

*Primary Examiner*—Eugene Eickholt

*Attorney, Agent, or Firm*—Fitzpatrick, Cella, Harper & Scinto

[57] ABSTRACT

Printing method and device enabling a low energy level to be indicated while extending the consumption duration and number of pages printed for a predetermined quantity of energy. According to the invention, detection of a predetermined quantity of energy remaining in an energy source (37) is interpreted by the control means (28) to switch to a printing mode which saves energy so as to indicate to the user an impending lack of energy, while using that which remains sparingly.

27 Claims, 6 Drawing Sheets

ENERGY SAVING IMAGE EDGING METHOD AND DEVICE

The invention relates to energy saving method and device for a system having an energy source, and more particularly concerns an enhancement which enables this energy to be saved when the energy source is hardly any longer able to supply sufficient energy to the system, while indicating to the user in a simple fashion the impending need to renew the energy of the said source.

For the clarity of the description, the words "energy sources" designate below both reservoirs of consumable materials, the consumption of which leads to a release of usable energy, and rechargeable accumulators and electric batteries or cells.

When an electrical system which consumes electrical energy has no means of detecting a fall in the level of energy available in the energy source, the only indicator informing the user that he should renew the energy of the said source is the halting of the operation of the system. There therefore results a loss of time in which to renew the energy or replace the energy source and start the system up again under the conditions in which it found itself at the time it stopped. In certain cases, such as that of communications systems, stoppage can lead to a loss of data. Some more sophisticated systems are equipped with means of detecting the quantity of energy available in the energy source. When the quantity of energy available is low or nil, a visual or audible signal or a message on a screen or a light emitting diode makes it known that the energy needs to be renewed. Signalling means must therefore be provided in addition to the detection means itself, which would increase the price of the system.

In the case of renewable energy sources, such as electrical energy coming from solar cells, a fall in the energy available can nonetheless take place, in the example, when the solar light weakens, the electrical supply systems generally switch to a battery and the same problems as those set out above arise.

One solution consists of increasing the capacity of the energy source so as to increase the maximum quantity of energy available. On the other hand, this solution leads to an increase in weight and bulk of the system and its cost.

Document Patent Abstract of Japan JP-85 0107460 (Tanabe et al., MATSUSHITA ELECTRIC IN CO LTD) discloses a printing device which is able to perform at least two printing modes which both have the same image quality, and which use different motor speeds in order to make the energy consumption vary with respect to these printing modes.

Documents EP-A-93 307002.1 (Horigome et al., CANON KABUSHIKI KAISHA) and US-A-4,407,003 (Hiroshi Fukui, CANON KABUSHIKI KAISHA) disclose printing devices which are able to perform at least two operating modes which both assure the same image quality and which, for the same image, require the same total energy consumption.

The basic idea of the invention consists of using a mode of operation with reduced energy consumption when the quantity of energy available in the energy source is low, thereby making it possible to indicate to the user by a simple means the need to renew the energy shortly (since the print appears in a different mode from the previous mode), while guaranteeing the printing of a larger number of pages with a reduced image quality, all other things being equal, before the energy source is no longer able to supply the necessary energy.

More precisely, the invention therefore concerns an energy saving method for an image transfer system able to operate, under the control of a processing means, according to one of at least two image transfer modes, a first one of these image transfer modes requiring a first energy consumption and providing a first image quality, and a second one of these image transfer modes requiring a second energy consumption and providing a second image quality, the second energy consumption and the second image quality being reduced with respect to the first ones, of the type consisting of assessing the quantity of energy remaining in an energy source and comparing it with a predetermined quantity of energy, characterised in that it consists of selecting the first image transfer mode when the quantity of energy remaining in the energy source is greater than the said predetermined quantity and the second image transfer mode when the quantity of energy remaining in the energy source is less than the said predetermined quantity of energy.

By means of these arrangements, when the quantity of energy available is low, the user is alerted to this fact and the consumption of energy required for the transfer of an image can be reduced in order to enable a larger number of pages to be transferred.

Furthermore, and especially in the case of electrical energy sources, when the energy source runs out, the maximum energy which can be delivered instantaneously decreases progressively. Beyond a certain threshold, the image transfer system, which operates according to the first transfer mode, stops because the energy source is no longer able to supply both the energy required to control the transfer system and that required for the transfer itself. On the other hand, where the second operating mode has a reduced instantaneous energy consumption compared to the first operating mode, the energy source is then still able to continue, at least for the time being, the transfer of images according to the second transfer mode.

It has to be noted that

- the first energy consumption is generally the nominal energy consumption,
- the image quality can be defined for example with respect to the size, the sharpness, the accuracy, the number of dots per inch, the number of colors and/or of grey levels used, the contrast or the easiness of understanding of each detail of said image and
- the second image quality is a predetermined, controlled and chosen image quality.

The arrangements of the present invention therefore enable the transfer of images to be prolonged with a reduced image quality rather than halting the operation of the image transfer system.

According to particular characteristics, the method according to the invention consists of performing, in certain image transfer modes, at least one image processing operation on the signals representing the image to be produced, the said image processing operation reducing the total surface area of the regions over which the ink is to be distributed.

By means of these arrangements, it being known that, in order to distribute ink over a given surface area, a certain quantity of energy is necessary, by reducing the total surface area over which the ink is to be distributed, the quantity of energy consumed in order to form an image is reduced.

According to particular characteristics, the image to be produced consists of elementary surfaces and the image processing operation acts upon the signals representing the image to be produced so as to reduce the number of the said elementary surfaces of the image over which the ink is to be distributed.

In particular, the image processing operation periodically eliminates elementary surfaces over which the ink is to be distributed.

By virtue of these arrangements, the appearance of the image is little changed; only its ink density is reduced.

According to other particular characteristics, the method according to the invention consists of producing, in certain image transfer modes, at least one change in the mechanical operation of the movement of an image transfer head, the said mechanical operation entailing a consumption of energy for the movement of the said head.

In particular, the said change in mechanical operation consists, in the first operating mode, of performing an image transfer during the outward movement of the transfer head in one direction of movement and not performing any image transfer during the return, in the other direction of movement, and in the second operating mode of performing an image transfer during the movement of the image transfer head in both directions of movement.

By virtue of these arrangements, the energy consumed to form two linear segments of an image is, according to the first transfer mode, the sum of the energies consumed to form each of the segments and the energies consumed to return to the starting point of the segment, without distributing any ink and, according to the second transfer means, solely the sum of the energies consumed to form each of the segments. The energy saved by the second transfer mode is therefore great.

According to other particular characteristics, in the second image transfer mode, the number of ink colors producing the image is reduced.

By virtue of these arrangements, the reading of the image with a reduced number of colors is still possible, but the energy for transferring some of the colors which forms the image is reduced. Thus only the colour density of the transferred image is modified.

According to its first aspect, the method according to the invention consists of transmitting signals towards the outside and awaiting from the outside either a signal representing decision criteria for a change in operating mode or a signal representing the change in operating mode.

By virtue of these arrangements, the method uses data and/or reference values coming from outside the image transfer system.

According to its second aspect, the method according to the invention consists of displaying the operating mode selected on a display, to invite the user to switch the operation to the second operating mode.

The advantage of this second aspect of the invention is that it is the user who chooses the operating mode to avoid, for example, two successive pages being of different quality in the same document.

According to its third aspect, the method according to the invention consists, when a predetermined level of energy has been passed, of automatically controlling the change in operating mode.

The advantage of this third aspect of the invention is that, even in the absence of the user, the halting of the operation is postponed, compared to the known devices. In the particular case of the incorporation of the device according to the invention into a printer, it is the halting of printing which is automatically postponed, in terms of the number of pages printed.

According to particular characteristics, the said image transfer system including a printing head itself includes a plurality of ink distribution channels, the said first operating mode uses all the said ink distribution channels, while the said second operating mode uses some of the said distribution channels.

The advantage of these operating modes is the simplicity of their use, which consists of selecting which channels operate. The energy consumption then decreases directly with the number of channels actually used.

According to other preferred characteristics, the method according to the invention consists of evaluating the quantity of energy which remains in the said energy source and comparing it with at least two predetermined quantities of energy, selecting the operating mode from amongst at least three operating modes whose energy consumptions are decreasing, and selecting the said operating mode, according to the said comparisons.

This embodiment has the main advantage that the energy consumption falls progressively, with more intermediate levels than there would be if there were only two operating modes. Consequently, the print quality remains good for longer, while the number of pages printed increases.

The invention also relates to an energy saving device for an image transfer system of the type having an energy source, means for detecting a predetermined quantity of energy in the said energy source adapted to transmit a signal representing the fact that this predetermined quantity has been passed, and a printing head comprising ink distribution means controlled by control signals representing information to be printed, characterised in that it includes control means suitable for generating first control signals for a first operating mode having a first energy consumption and providing a first image quality and second control signals for a second operating mode having a second energy consumption and providing a second image quality, the second energy consumption and the second image quality being reduced with respect to the first ones, and a processing means adapted to select the said operating mode, according to the signal transmitted by the said energy quantity detection means.

According to particular characteristics, the processing means is adapted, when the detection means have detected the passing of a predetermined energy quantity level has been passed, to control the display, on a display, of messages representing a proposed selection of the second operating mode.

According to other particular characteristics, the processing means is adapted, when the detection means have detected the fact that a predetermined energy level has been passed, to control the change in operating mode.

According to other particular characteristics, the device according to the invention includes a printing control means adapted to control a uni-directional printing mode and a bi-directional image transfer mode.

The advantage of this operating mode is that the printing is only very slightly degraded by the change in the printing mode.

According to other particular characteristics, the device according to the invention includes a printing control means adapted to control a monochrome printing mode and a multi-colour printing mode.

According to other particular characteristics, the said printing head having a plurality of ink distribution channels each associated with a trigger component suitable for producing the ejection of an ink drop through the orifice of the corresponding ink ejection channel, the said control means are suitable for inhibiting some of the said trigger components when the said second operating mode is used.

According to other particular characteristics, the said trigger components being arranged in a matrix network connected to two groups of connection points connected respectively to corresponding amplifiers/switches, themselves controlled by the said control means, the said control means are arranged to eliminate some of the signals applied to at least one such amplifier/switch.

According to other particular characteristics, the said printing head having a plurality of ink distribution channels each associated with a trigger component suitable for producing the ejection of an ink drop through the orifice of the corresponding ink ejection channel, when the said second operating mode is used, the said control means are arranged so as to eliminate some of the signals applied to at least one such trigger component.

According to other particular characteristics, the said trigger components are resistances housed respectively in the aforementioned distribution channels.

According to other particular characteristics, the control means are suitable for generating control signals for at least three operating modes whose energy consumptions are decreasing, the detection means for the quantity of energy remaining are adapted to transmit a signal representing the fact that at least two predetermined energy levels have been passed in the said energy source, and the processing means is adapted to select the said operating mode, according to the signal transmitted by the said means for detecting the level of energy.

According to other particular characteristics, the processing means is adapted, for certain operating modes, to effect or control the performance of at least one image processing operation on the signals representing the image to be produced, the said image processing operation reducing the total surface area of the regions where the ink is to be distributed.

This embodiment is particularly advantageous where large areas to be printed are present, or when numerous characters are transmitted. This is because characters are able to be read independently of their thickness, while the energy corresponding to their printing increases with their thickness.

By means of the invention, the capacity of the image transfer device to print data when the quantity of energy available in the energy source is below a predetermined threshold is substantially extended. Thus, during the consumption of the greater part of the energy of the energy source, the user enjoys excellent reproduction quality and the automatic implementation of the invention makes it possible, when the available energy is too low, on the one hand, to indicate the need to renew the energy of the energy source and, on the other hand, to increase the number of pages corresponding to the consumption of the energy available.

The invention also relates to a facsimile machine, printer, a photocopier, a computer and more generally installations consuming energy including the energy saving device and/or implementing the method of the invention, as disclosed succinctly hereinafter.

The invention will be better understood, and other advantages thereof will emerge more clearly, in the light of the description that follows of a facsimile machine device in accordance with its principle, given solely by way of example and made with reference to the accompanying drawings in which.

In the following description, the first energy consumption is supposed to be the nominal energy consumption and the second energy consumption is reduced with respect to the first one.

Figure 1:
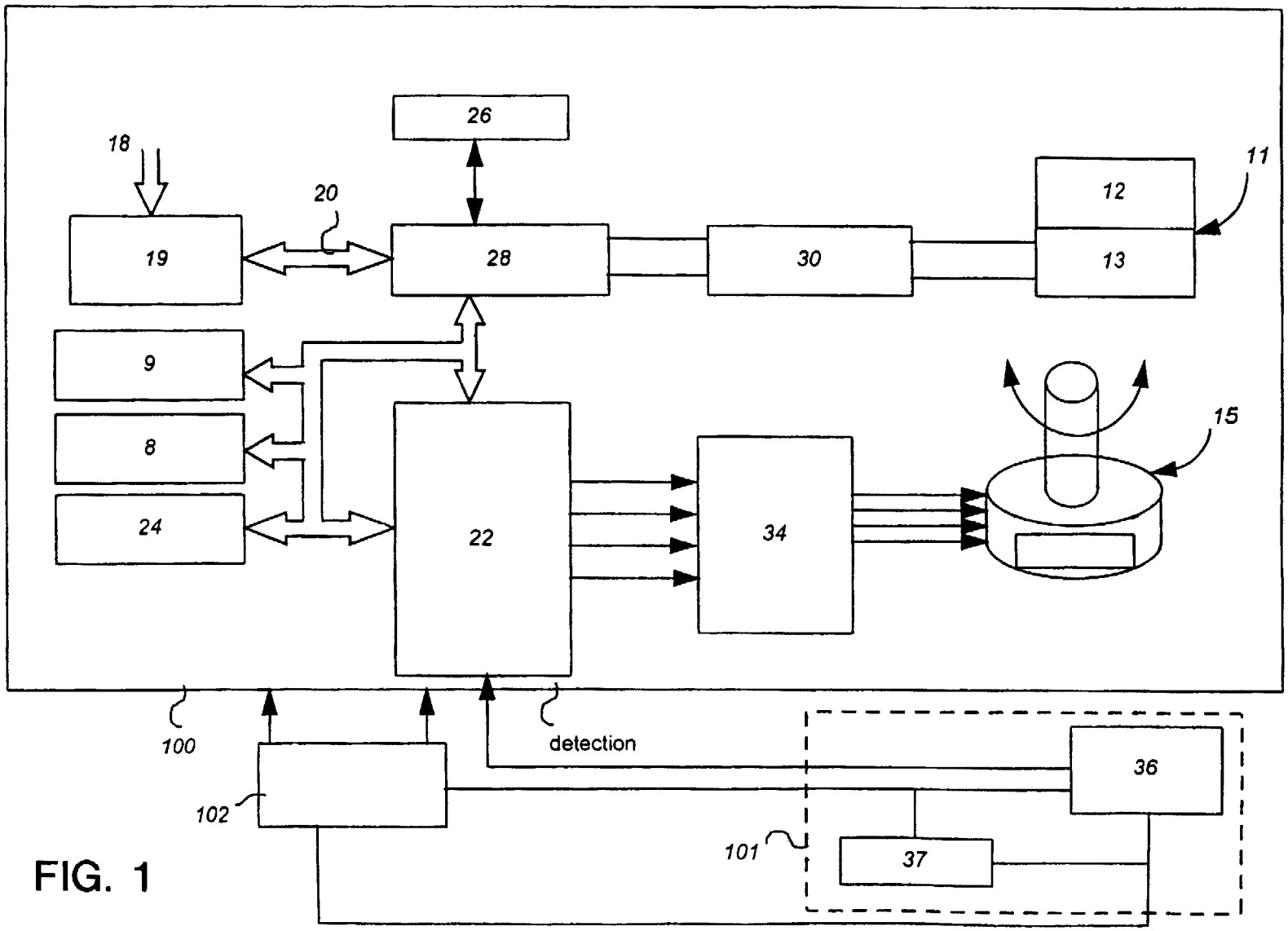
FIG. 1 is a block diagram illustrating the printing means of a facsimile machine.

The device according to the invention depicted in FIG. 1 includes, on the one hand, a printing device 100 and, on the other hand, an electrical power supply device 101.

The printing device 100 of the facsimile machine to which the invention applies includes a replaceable cartridge 11 composed essentially of an ink reservoir 12 and a printing head 13, movably mounted on a device moving to and fro in translation and actuated by a motor 15. The facsimile machine includes a parallel port of the type known under the name "Centronic" 18, known per se, which does not form part of the invention, suitable for receiving signals representing graphical data to be reproduced, transmitted on telephone channels (not shown). This port 18 is connected to the printing means by means of an interface circuit 19 for converting the data received by the parallel port 18 into logic signals conveyed by an eight-bit parallel link 20. The facsimile machine also includes a processing means 22, associated with a read-only memory 24 and a random access memory 26. The read-only memory 24 contains the operating programs of the processing means while the random access memory 26, also associated with ink ejection control means 28, temporarily stores the data received through the interface 19 and the data processed by the processing means 22.

The ink ejection control means 28 control the printing head by means of amplification means 30. The processing means 22 is connected to a display 8, on which the processing means 22 is adapted to control the display of messages representing the operation of the facsimile machine, and to a keypad 9, having at least one switch, through which the user can give operating commands to the facsimile machine, such as asking it to switch from one operating mode to another for example.

The processing means 22 is also adapted to effect or control at least one image processing operation performed on the signals representing the image to be produced by ink jet, the said image processing operation reducing the total surface area of the regions where the ink is to be distributed. By way of examples of such image processing operations, it is possible to cite two-dimensional derivation, which leaves only the transition areas of an image, scaling down, which reduces the size of the whole image, skeletonisation, which reduces the thickness of the characters and patterns to be printed without cutting lines, and reduction in the width of segments to be inked in, a width measured on each image processing line.

The processing means 22 is finally adapted to produce or control at least one uni-directional printing, that is to say performed when the printing head moves in one direction and not when the printing head moves in the opposite direction, and bi-directional printing, that is to say performed both when the printing head moves from left to right and when the printing head moves from right to left. This bidirectional printing is performed according to methods known to persons skilled in the art.

The processing means 22 is also connected to the motor 15 via an amplification circuit 34. The stepping motor 15 moves a carriage carrying the printing head 13. A detector is positioned opposite the path of the printing head 13 to determine the position thereof and transmit information representing it to the processing means 22.

The electrical supply device 101 includes a battery 37 and a charge monitor 36. The battery 37 is of the type known in the field of electrical energy sources. It can, for example, consist of an accumulator, one or more cells, rechargeable or otherwise, or a battery of accumulators. The charge monitor can be integrated into the battery, which then becomes a so-called "intelligent" battery. The charge monitor 36 is electrically connected to the battery 37 and to the processing means 22. It supplies a digital signal, which can be binary, representing the electrical energy available in the battery 37, the signal leaving the charge monitor then adopting two logic states representing in one case the fact that the quantity of energy available in the battery 37 is greater than a predetermined quantity of energy and in the other case that the quantity of energy available in the battery 37 is less than the predetermined quantity of energy. The battery is also connected to an energy distribution means 102 distributing the energy from the battery 37 to the various electrical components.

As indicated previously, it is the detection of the passing of this predetermined quantity of energy which enables the operating mode to be modified automatically, in order to save energy until it is renewed. Of course, the invention applies whatever the nature of the means of measuring the quantity of energy remaining in the battery 37.

When the passing of the predetermined remaining quantity of available energy has been detected, this means that the quantity of energy which remains is less than a predetermined quantity. The processing means 22 controls the display on the display of messages representing a proposed selection by the user of the second operating mode and/or the processing means controls the changeover of the operating mode to change to the second mode.

Figure 9:
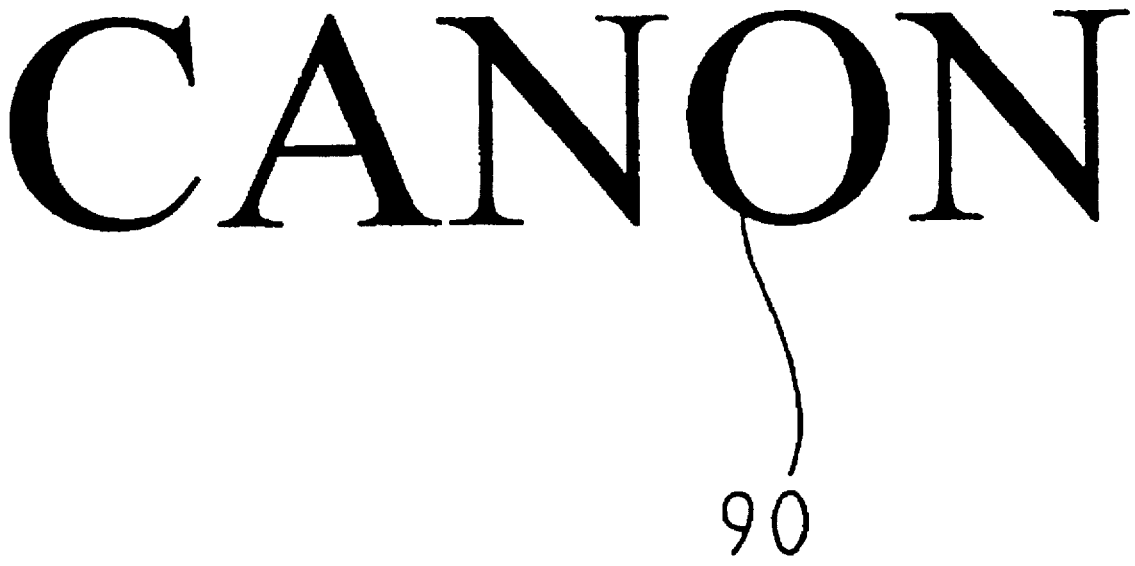
FIG. 9 is an enlargement of two identical words produced according to two different image transfer modes.
Figure 9:
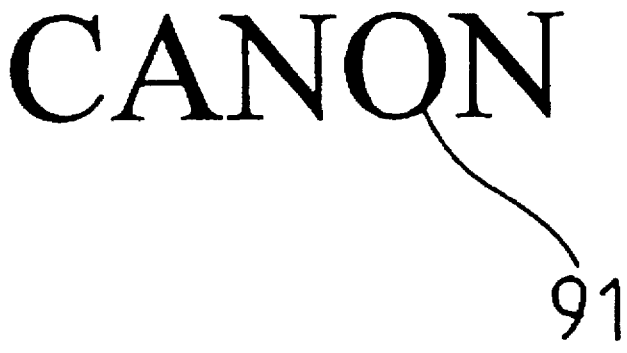

The second operating mode can consist of:

performing one of the image processing operations reducing the total surface area of the regions in which the ink is to be distributed, and then printing the image resulting from this image processing;

performing a bi-directional printing, that is to say both during the outward travel of the carriage from one side of the sheet to the other and during the return travel. For example, in the case of the printer with the reference BJ-10 from CANON (Japan), the return consumption, without printing, represents approximately 350 mA. This consumption is saved in the second image transfer mode, since no return is made without printing;

producing a reduction in the number of points on the printing head which are permitted to eject ink simultaneously, as presented in conjunction with the following figures. It should be noted, in relation to this, that in the case of the printer cited above, the consumption is, when all the ink ejection channels are operating, approximately 750 mA, approximately 620 mA when an average of half the said channels are operating, as presented in an example in FIG. 8;

changing the format of the image by scaling down at least one of its dimensions, as presented in an example in FIG. 9;

and/or changing the number of colors of ink used to produce the image.

In all the afore-mentioned examples, the second operating mode and the corresponding image transfer mode require a second energy consumption and provide a second image quality, the second energy consumption and the second image quality being reduced with respect to the first ones, respectively relating to the first operating modes and the corresponding image transfer mode.

Figure 2:
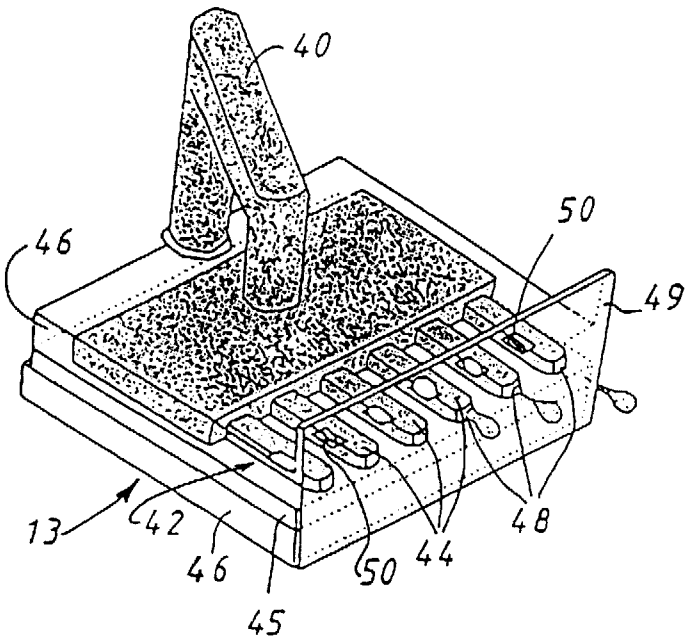
FIG. 2 is a simplified diagrammatic view of a printing head of the ink drop ejection type, used in the facsimile machine in FIG. 1.

In FIG. 2, only the printing head 13 has been depicted. A joining pipe 40 can be seen therein, connected by a filter to the said reservoir (not shown) and connected to ink ejection means 42 comprising a plurality of parallel ejection pipes 44. The latter are arranged on a silicon plate 45, itself carried by an aluminium-based plate. The said pipes are, moreover, integrated into a glass structure 46 covering the silicon plate. The latter has the electronic connections and components depicted in FIG. 3. The ejection pipes 44 are arranged parallel and spaced regularly in the same plane parallel to that of the silicon plate. They are connected to the ink reservoir and end in respective ink ejection orifices 48, defined in a front plate 49 situated opposite the sheet of paper to be printed. All the orifices 48 are disposed side-by-side, regularly spaced out along a straight-line segment.

FIG. 2 is a simplified diagrammatic view on which only six ejection channels 44 have been depicted. In fact, the ejection head has sixty four of these; it moves perpendicularly to the alignment of the ejection channels. Each ejection channel encloses a trigger component, in the example a resistance 50 forming an electrothermal converter. It functions as follows. For each position of the printing head with respect to the sheet of paper, according to the data to be printed, a certain number of resistances 50 are fed for a certain time. The energy dissipated in this resistance vaporises a small quantity of ink situated in the corresponding ejection channel. This vaporisation leads to the formation of a bubble of ink vapor. A drop of ink is ejected from the corresponding orifice under the effect of the pressure exerted by the bubble.

The invention applies advantageously but not exclusively to this type of printing head. For example, the trigger components could be different. Piezoelectric transducers or systems of printing on thermal paper, which consist of heating a resistance close to the paper when the printing of a black dot is required, could notably be used.

Figure 3:
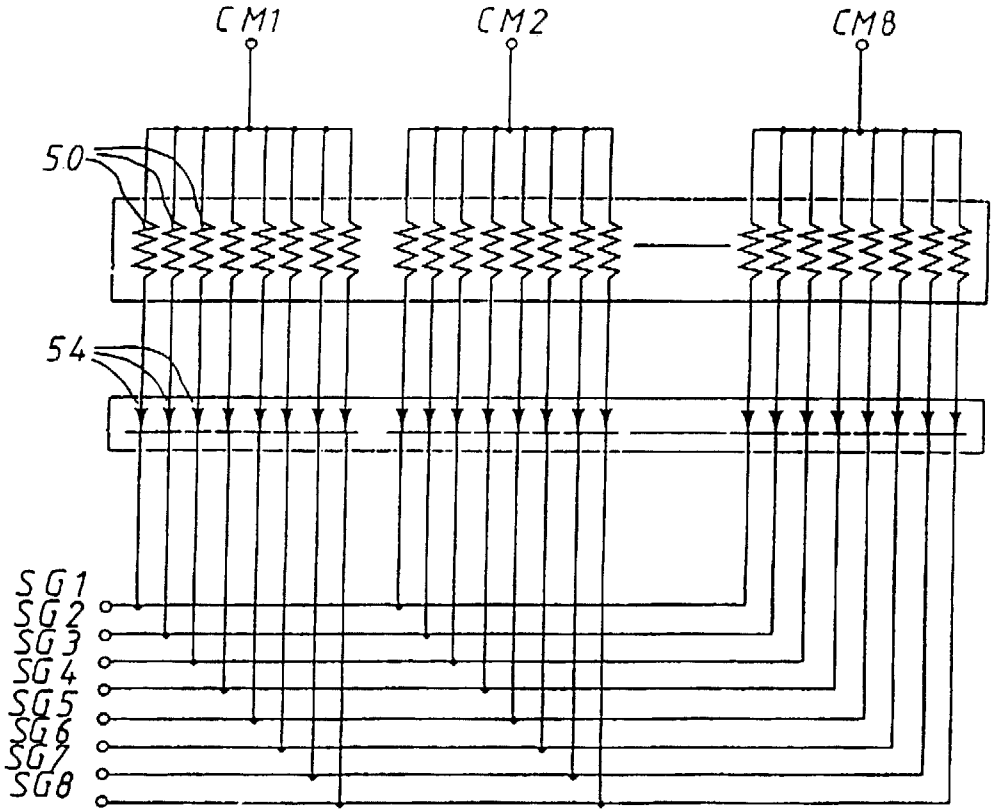
FIG. 3 is a diagram of an electrical part of the ink ejection means, situated in the movable printing head.

Looking at FIG. 3, it can be seen that the printing head 13 has sixty four heating resistances 50 forming the electrothermal converters integrated into the ejection channels 44 and sixty four diodes 54. Each resistance 50 is in series with a diode 54 and this connection in series forms a branch of a kind of matrix network established between eight connection points CM1–CM8 and eight connection points SG1–SG8. In the rest of the text, a connection point CM1–CM8 is called a "common connection point" while a connection point SG1–SG8 is called a "segment connection point". The resistances 50 are connected together in groups of eight and each of these groups of eight is connected to a common connection point CM1–CM8. The other pole of each resistance 50 is connected to the anode of an associated diode 54. The cathodes of these diodes are connected to each other in groups of eight, each of these groups being connected to a segment connection point. The branches 50, 54 connected to the same segment connection point belong to different aforementioned groups of branches, each group corresponding to a particular common connection point. The feeding of each resistance 50 is thus ensured by passing a current between a common connection point CM1–CM8 and a segment connection point SG1–SG8.

Figure 4:
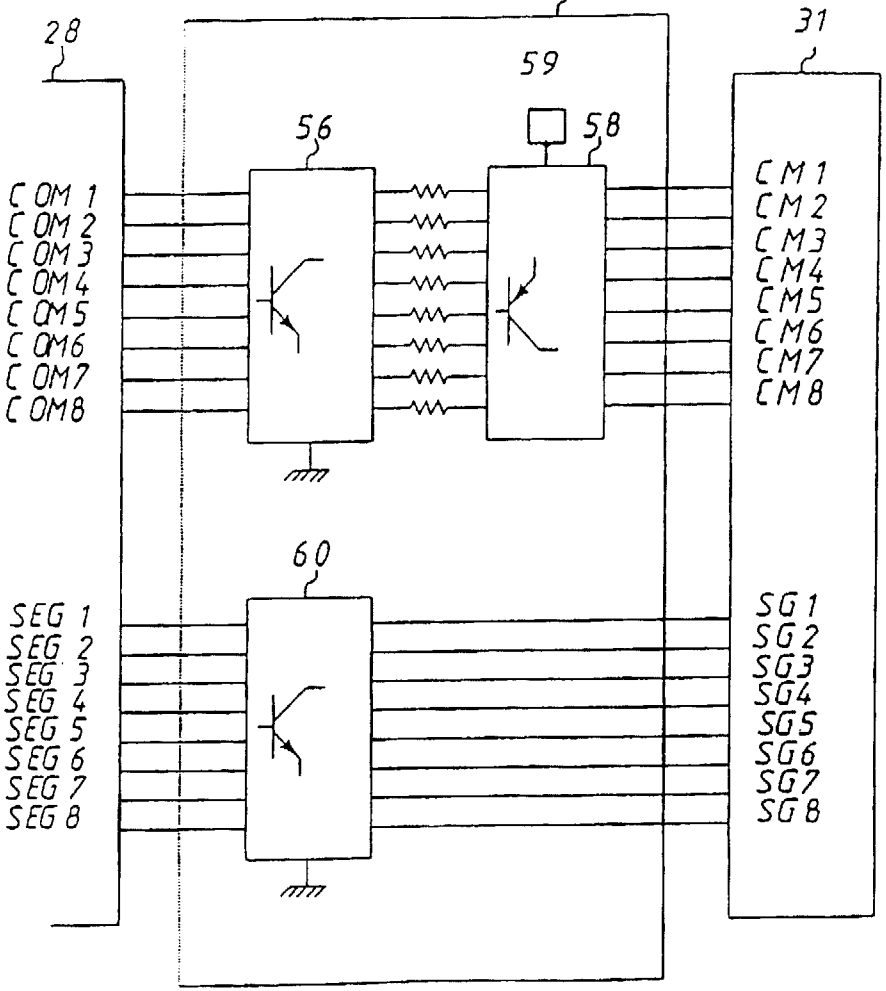
FIG. 4 is a diagram of a part of the control means for the said ink ejection means.

FIG. 4 depicts the amplification means 30 suitable for supplying the current pulses to the resistances. This unit is carried by the facsimile machine rather than by the replaceable cartridge. A preamplifier 56 with eight inputs and eight outputs can be seen. The outputs of the preamplifier are connected to the respective eight inputs of an amplifier/switch 58 connected to a current source 59. The eight outputs of the amplifier/switch 58 are respectively connected to the connection points CM1–CM8. Another amplifier/switch 60 has eight inputs and eight outputs, each of these being connected respectively to a segment connection point SG. This amplifier/switch 60 has a common earth connection and enables one of the segment connection points SG1–SG8 to be connected to earth when a signal is applied to its corresponding input.

Figure 5:
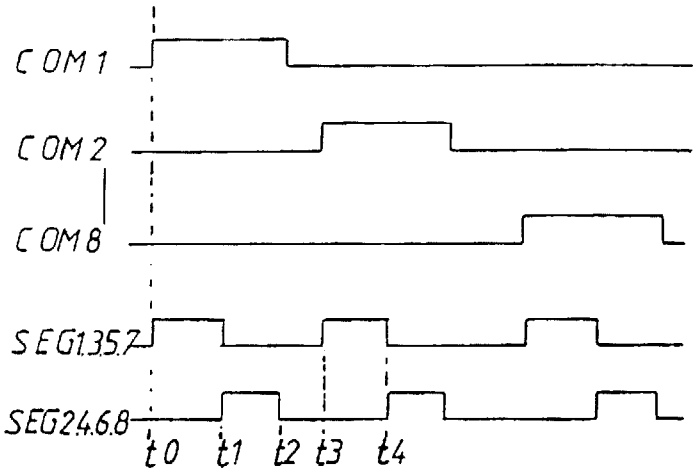
FIG. 5 is a timing diagram illustrating a first operating mode with normal energy consumption, ensuring high-quality reproduction.

Thus a current can be established through a resistance selected in response to the control signals generated by the ink ejection control means 28 having only eight outputs COM1–COM8 connected to the inputs of the preamplifier 56 and eight outputs SEG1–SEG8 connected to the inputs of the amplifier/switch 60. FIG. 5 depicts a timing diagram of the control signals generated by the control means that have just been described. The signals COM1–COM8 follow each other cyclically so that, at a given moment, a group of eight resistances 50 is able to have a current passing through it. During the same time, the signals SEG1–SEG8 are generated selectively in correspondence with the data to be reproduced.

In the example in FIG. 5, it is assumed that the information to be reproduced at a given moment necessitates the printing of the sixty four available dots. Thus the resistance 50 accessible between the common connection point CM1 and the segment connection point SG1 can have a current passing through it during the period of time $t_0$–$t_1$, and the resistance connected between the points CM2 and SG3 can have a current passing through it during the period of time $t_2$–$t_3$.

In this first, so-called normal or high-definition operating mode, all the ejection channels 44 are able to be used to print the data to be reproduced. Energy consumption is referred to as "nominal".

According to a notable characteristic of the invention, the printer of the facsimile machine operates according to the first operating mode described above so long as the assessment of the quantity of energy remaining in the energy source 37, an assessment performed by the charge monitor 36, indicates that this quantity is greater than the predetermined quantity of energy (for example 25% of the maximum quantity of energy of the energy source) but automatically chooses (under the control of the processing means 22 using the information delivered by the charge monitor 36) a second operating mode with reduced energy consumption when the result of the assessment indicates that the quantity of energy remaining in the battery has reached or is below the said predetermined quantity of energy. The second operating mode is maintained until the energy in the battery 37 is completely exhausted or it is replaced. It enables the service life of the latter to be extended at the cost of a paler and/or slightly degraded print.

Figure 6:
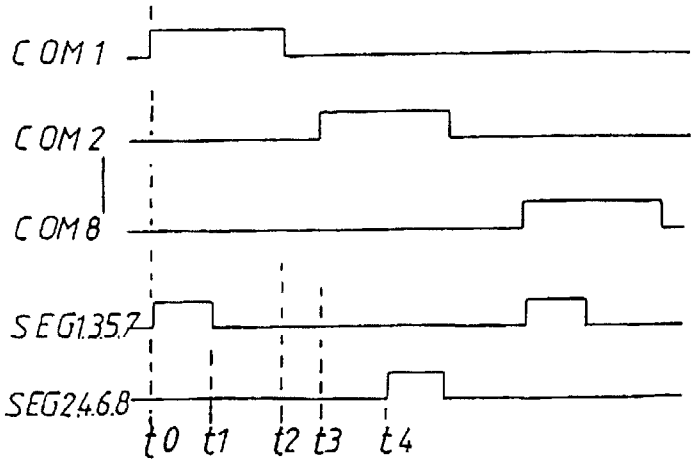
FIG. 6 is a timing diagram comparable to that of FIG. 5, illustrating an operating mode with reduced energy consumption.

In the example described, the second embodiment uses only some of the said ejection channels 44. FIG. 6, which is comparable with FIG. 5, shows that this result is obtained by inhibiting some of the said trigger components (that is to say the resistances 50) when the said second operating mode is used. As illustrated, it is possible to prevent certain pulses SEG from being transmitted or to suppress them, for example one out of two. To this end, the processing means 22 runs a special program resident in the read-only memory 24 which results in the elimination of certain pulses SEG which would normally control the amplifier/switch 60.

The choice of the inhibited ejection channels can obey predetermined rules. In a simple version, the inhibited resistances are always the same ones. According to a variant, the inhibited resistances are inhibited in a circular rotation. It is also possible to choose to inhibit certain resistances according to the information to be reproduced. Notably, it is possible to choose to eliminate corresponding signals SEG corresponding to the ink dots situated at the periphery of the character to be reproduced, resulting in a "thinning" thereof. Furthermore, if the charge monitor 36 for the battery 37 is arranged to deliver data representing several decreasing predetermined quantities of energy, it is possible to adapt the control means 28 so that the latter inhibit an ever greater number of trigger components as these decreasing quantities of remaining available energy are reached.

Figure 7:
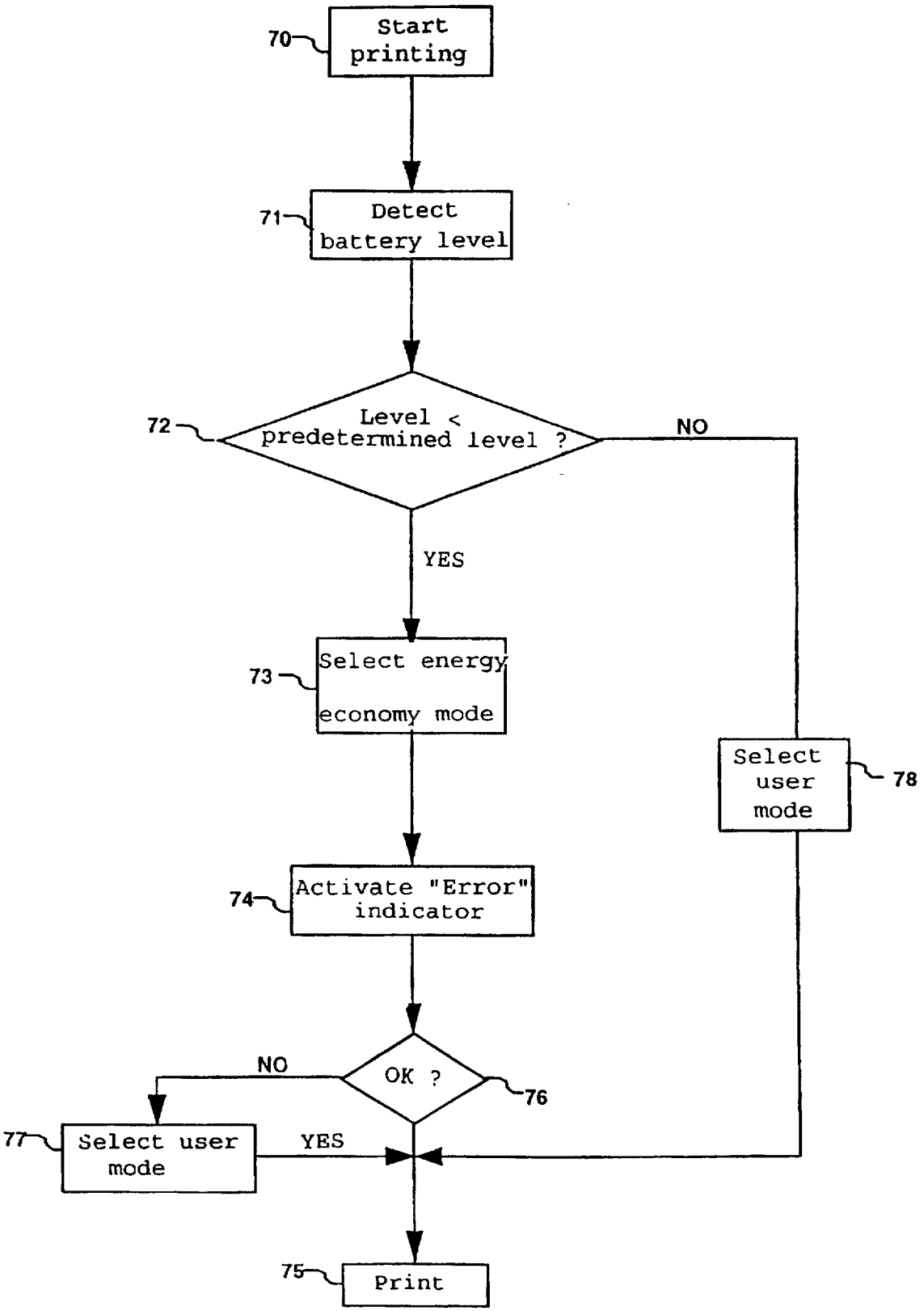
FIG. 7 is a flow diagram of the operation of the device according to the invention.

The flow diagram in FIG. 7 illustrates the operation of the processing means 22, associated with the read-only memory 24 which contains the program corresponding to this flow diagram. In this flow diagram, the operation 70 corresponds to the start of the printing of a sheet of paper. According to other embodiments, or variants, the flow diagram in FIG. 7 can be triggered with a shorter period, for example at the start of each printed line, or longer, for example at each start of a series of pages in the same document.

Then the operation 71 consists of initiating a charge monitoring by the charge monitor 36. The test 72 consists of determining whether or not the level of energy remaining in the battery 37 is less than the predetermined level. In the affirmative case, the operation 73 consists of selecting the printing mode which is most economical in terms of energy, as presented in the description in FIG. 6. Then the operation 74 consists of displaying a message representing the low energy level on the display 8 (symbolised in FIG. 7 by the message "error"). Thereafter, the test 76 consists of awaiting agreement from the user for a certain time, an agreement given by use of the keypad. If there is no response within the predetermined period or when agreement is explicitly given, the printing operation 75 is performed with the energy saving printing mode. If the user indicates disagreement during the test 76, he needs to select a printing mode during the operation 77. The printing is then performed during the operation 75 with the printing mode selected by the user during the operation 77.

If the result of the test 72 is negative, the operation 78 consists of selecting the printing mode requested by the user by using the keypad according to known techniques. Following this operation 78, the operation 75 effects the actual printing of the page, according to the operating mode selected.

Figure 8:
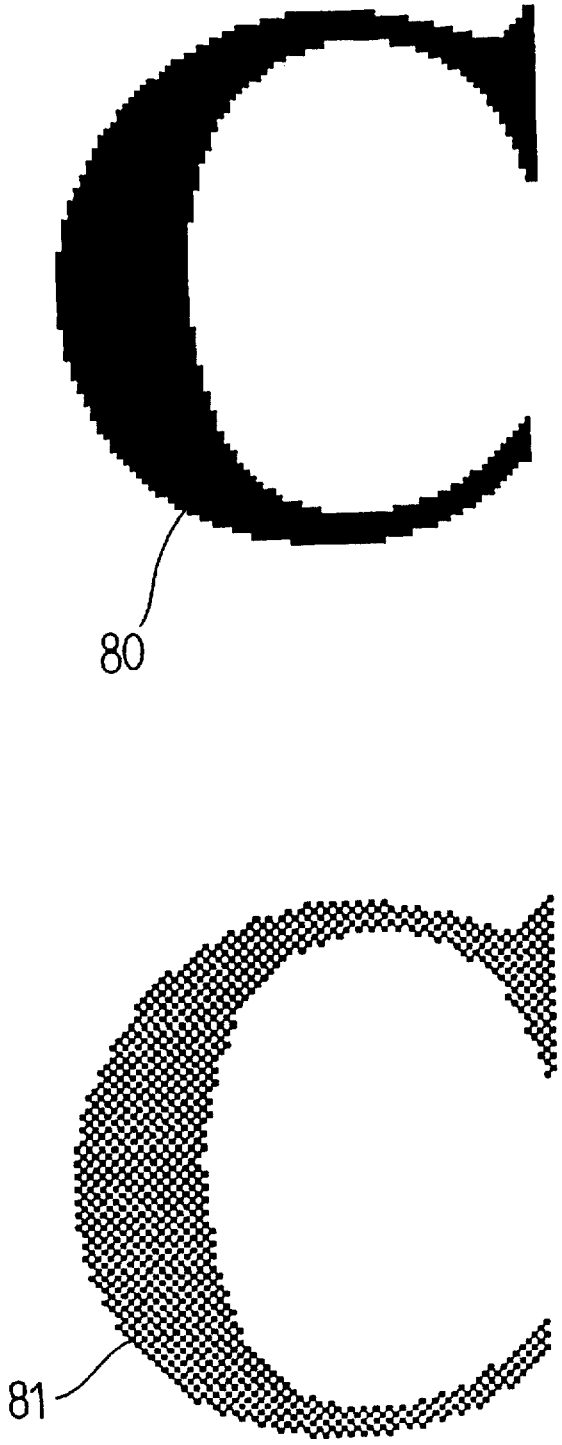
FIG. 8 is an enlargement of two letters "C" produced according to two different image transfer modes.

According to variants which are straightforward for experts, the image transfer mode selection operations 73, 77 and 78 allow a choice between the highest-quality transfer mode, which is also the least economical in terms of energy, and one of the economy transfer modes, for example those presented in conjunction with FIGS. 8 and 9.

FIG. 8 shows, through enlargements produced to the same scale, two letter "CC"s of the same size, in the same font and with the same characteristics, produced according to two different image transfer modes. The letter "C" 80 is produced according to the first image transfer mode and has a solid surface, that is to say without discontinuity. The letter "C" 81, on the other hand, is produced according to the second image transfer mode, as presented above. Its surface is formed from alternate light square areas and dark square areas, both vertically and horizontally. As disclosed above, each of the regions on which ink is distributed corresponds to a quantity of energy consumed. The letter "C" 81, which is just as legible as the letter "C" 80, therefore corresponds to a lower total energy consumption than the letter 80.

FIG. 9 depicts another example of image processing which substantially maintains the legibility of an image, of a word in this case, while reducing the quantity of energy required to form it. The words 90 and 91 are enlargements, to the same scale, of words formed, with the same signals representing images, according to a first and second image transfer mode according to the present invention. The word 90 is of normal size, while the word 91 is, compared with the word 90, a half-scale reduction of the word 90. The total surface area of paper over which the ink needs to be distributed is four times smaller to form the word 91 than to form the word 90. The image processing required in order to use the second image transfer mode is well known to experts, replacing four dots in the first image with a single dot in the second one, giving a tint to it as soon as one of the four original dots has one.

The quantity of energy to form the image of the word 91 is much less than that needed to form the image of the word 90.

Of course, the invention is in no way limited to the embodiments described in conjunction with the accompanying figures, but on the contrary encompasses any variant, any modification or any enhancement within reach of experts.

In particular, in variants applying to multi-colour printing, the operating modes which save energy include reduction of the number of colors of the inks distributed, to save the energy needed to print each of the colors withdrawn.

According to another variant, at least one image transfer mode which saves energy is produced with a reduction in the format of the image, in at least one direction.

In particular, the invention applies easily to facsimile machines, but also to printers, photocopiers and more generally to installations consuming electrical energy and, still more generally, installations consuming energy.

For facsimile machines, printers or photocopiers adapted to producing areas having different grey levels, that is to say for facsimile machines adapted to distribute at least two different densities of ink per unit of surface area, and a charge monitor adapted to detect the fact that at least one predetermined energy quantity level remaining in the battery has been passed, the method and device are easily arranged by experts so that, for each predetermined quantity of energy whose passing is detected, there corresponds a change in the energy consumption per surface unit inked in.

According to a variant, when the detection means detect the fact that the quantity of energy remaining has dropped below a predetermined level, the processing means 22 controls the display, on the display 8, of a message representing an invitation to change the operating mode so that the user is prompted to request, by means of the keypad 9, a change to a second operating mode with reduced energy consumption. According to another variant, it is a sound that is transmitted by an electroacoustic transducer, not shown, when the detection means detect the passing of a predetermined remaining quantity of energy.

According to another variant, the processing means 22 being adapted, for operating modes consuming a reduced quantity of energy, to perform or control at least one image processing operation on the signals representing the image to be produced by ink jet, the said image processing operation reducing the total surface area of the regions where the ink is to be distributed, when the detection means detect the fact that the quantity of energy remaining has dropped below a predetermined level, the control means control the performance of the said image processing operation.

According to another variant, the processing means 22 is external to the said image transfer system, being, for example, incorporated into a data processing system connected to the device according to the present invention.

According to a last variant, when the charge monitor detects the fact that the quantity of energy remaining has dropped below a predetermined level, the processing means 22 controls the transmission of a signal towards the outside, for example via an electrical connector, the said signal representing an invitation to change the operating mode. Then the processing means 22 awaits from the outside:

either a signal representing decision criteria for a change of operating mode, which criteria it uses to decide whether or not to change to a second operating mode with reduced energy consumption;

or a signal representing a reference value for change to a second operating mode with reduced energy consumption.

I claim:

1. Energy saving method for an image transfer system able to operate, under the control of a processing means (22), according to one of at least two image transfer modes, a first one of these image transfer modes requiring a first energy consumption and providing a first image quality, and a second one of these image transfer modes requiring a second energy consumption and providing a second image quality, the second energy consumption and the second image quality being reduced with respect to the first ones, the second image transfer mode being one wherein edging processing is performed to reduce a total surface area of ink application as compared with the first image transfer mode by relatively emphasizing edge areas of an image relative to non-edge areas thereof, said processing means being of the type consisting of assessing a quantity of energy remaining in an energy source and comparing it with a predetermined quantity of energy, characterised in that it consists of selecting the first image transfer mode when the quantity of energy remaining in the energy source is greater than the predetermined quantity and the second image transfer mode when the quantity of energy remaining in the energy source is less than the predetermined quantity of energy.

2. Method according to claim 1, characterised in that it consists of performing, in certain image transfer modes, at least one image processing operation on the signals representing the image to be produced, the said image processing operation reducing the total surface area of the regions over which the ink is to be distributed.

3. Method according to claim 2, characterised in that the image to be produced consists of elementary surfaces and in that the image processing operation acts upon the signals representing the image to be produced so as to reduce the number of the said elementary surfaces of the image over which the ink is to be distributed.

4. Method according to claim 3, characterised in that the image processing operation periodically eliminates elementary surfaces over which the ink is to be distributed.

5. Method according to claim 1, characterised in that it consists of producing, in certain image transfer modes, at least one change in the mechanical operation of the movement of an image transfer head, the said mechanical operation entailing a consumption of energy for the movement of the said head.

6. Method according to claim 5, characterised in that the change in mechanical operation consists, in the first operating mode, of performing an image transfer during the outward movement of the transfer head in a direction of movement and not performing any image transfer during the return, in the other direction of movement, and, in the second operating mode, of performing an image transfer during the movement of the image transfer head in both directions of movement.

7. Method according to claim 1, characterised in that, in the second image transfer mode, the number of colors of ink producing the image are reduced.

8. Method according to claim 1, characterised in that it consists of transmitting signals towards the outside and awaiting from the outside either a signal representing decision criteria for a change in the operating mode or a signal representing the change in the operating mode.

9. Method according to claim 1, characterised in that it consists of displaying the operating mode selected on a display, to invite the user to switch the operation to the second operating mode.

10. Method according to claim 1, characterised in that it consists, when a predetermined energy level has been passed, of automatically controlling the change in operating mode.

11. Method according to claim 1, the said image transfer system including a printing head having a plurality of ink distribution channels (44), characterised in that the said first operating mode uses all the said ink distribution channels (44) while the said second operating mode uses some of the said distribution channels.

12. Method according to claim 1, characterised in that it consists of evaluating the quantity of energy which remains in the said energy source and comparing it with at least two predetermined quantities of energy, selecting the operating mode from amongst at least three operating modes whose energy consumptions are decreasing, and selecting the said operating mode, according to the said comparisons.

13. Energy saving device for an image transfer system of the type having an energy source (37), means (15, 22, 36) for detecting a predetermined quantity of energy in said energy source adapted to transmit a signal representing that this predetermined quantity has been passed, and a printing head (13) comprising ink distribution means (42) controlled by control signals representing information to be printed, characterised in that it includes control means (28) for generating first control signals for a first operating mode having a first energy consumption and a first image quality and second control signals for a second operating mode having a second energy consumption and providing a second image quality, the second energy consumption and the second image quality being reduced with respect to the first ones, the second image transfer mode being one wherein edging processing is performed to reduce a total surface area of ink application as compared with the first image transfer mode by relatively emphasizing edge areas of an image relative to non-edge areas thereof, and a processing means (22) for selecting one of the operating modes according to the signal transmitted by said energy quantity detection means, said processing means selecting the second image transfer mode when the signal is transmitted to indicate that an available amount of energy in said energy source is less than the predetermined amount of energy.

14. Device according to claim 13, characterised in that the processing means (22) is adapted, when the detection means have detected the passing of a predetermined quantity of energy, to control the display on a display (8) of messages representing a proposed selection of the second operating mode.

15. Device according to claim 13, characterised in that the processing means (22) is adapted, when the detection means have detected the passing of a predetermined quantity of energy, to control the change in operating mode.

16. Device according to claim 13, characterised in that it includes a printing control means (22) adapted to control a uni-directional printing mode and a bi-directional image transfer mode.

17. Device according to claim 13, characterised in that it includes a printing control means (22) adapted to control a monochrome printing mode and a multi-colour printing mode.

18. Device according to claim 13, in which he said printing head (13) has a plurality of ink distribution channels (44) each associated with a trigger component (50) suitable for producing the ejection of an ink drop through the orifice of the corresponding ink ejection channel, characterised in that the said control means (28) are suitable for inhibiting some of the said trigger components when the said second operating mode is used.

19. Device according to claim 18, in which the said trigger components (50) are arranged in a matrix network connected to two groups of connection points (CM, SG) connected respectively to corresponding amplifiers/switches, themselves controlled by the said control means (28), characterised in that the said control means (28) are arranged to eliminate some of the signals applied to at least one such amplifier/switch (60).

20. Device according to claim 13, in which the said printing head (13) has a plurality of ink distribution channels (44) each associated with a trigger component (50) suitable for producing the ejection of an ink drop through the orifice of the corresponding ink ejection channel, characterised in that, when the said second operating mode is used, the said control means (28) are arranged so as to eliminate some of the signals applied to at least one such trigger component (50).

21. Device according to claim 18, characterised in that the said trigger components are resistances (50) housed respectively in the aforementioned distribution channels.

22. Device according to claim 13, characterised in that the control means (28) are suitable for generating control signals for at least three operating modes with decreasing energy consumptions, in that the means of detecting the remaining energy level are adapted to transmit a signal representing the passing of at least two predetermined energy levels in the said energy source (37), and in that the processing means (22) is adapted to select the said operating mode, according to the signal transmitted by the said energy level detection means.

23. Device according to claim 13, characterised in that the processing means (22) is adapted, for certain operating modes, to effect or control the performance of at least one image processing operation on the signals representing the image to be produced, the said image processing operation reducing the total surface area of the regions in which the ink is to be distributed.

24. Facsimile machine, characterised in that it includes an energy saving device for an image transfer system of the type having an energy source (37), means (15, 22, 36) for detecting a predetermined quantity of energy in said energy source adapted to transmit a signal representing that this predetermined quantity has been passed, and a printing head

(13) comprising ink distribution means (42) controlled by control signals representing information to be printed, wherein said energy saving device includes control means (28) for generating first control signals for a first operating mode having a first energy consumption and a first image quality and second control signals for a second operating mode having a second energy consumption and providing a second image quality, the second energy consumption and the second image quality being reduced with respect to the first ones, the second image transfer mode being one wherein edging processing is performed to reduce a total surface area of ink application as compared with the first image transfer mode by relatively emphasizing edge areas of an image relative to non-edge areas thereof, and a processing means (22) for selecting one of the operating modes according to the signal transmitted by said energy quantity detection means, said processing means selecting the second image transfer mode when the signal is transmitted to indicate that an available amount of energy in said energy source is less than the predetermined amount of energy.

25. Photocopier, characterised in that it includes an energy saving device for an image transfer system of the type having an energy source (37), means (15, 22, 36) for detecting a predetermined quantity of energy in said energy source adapted to transmit a signal representing that this predetermined quantity has been passed, and a printing head (13) comprising ink distribution means (42) controlled by control signals representing information to be printed, wherein said energy saving device includes control means (28) for generating first control signals for a first operating mode having a first energy consumption and a first image quality and second control signals for a second operating mode having a second energy consumption and providing a second image quality, the second energy consumption and the second image quality being reduced with respect to the first ones, the second image transfer mode being one wherein edging processing is performed to reduce a total surface area of ink application as compared with the first image transfer mode by relatively emphasizing edge areas of an image relative to non-edge areas thereof, and a processing means (22) for selecting one of the operating modes according to the signal transmitted by said energy quantity detection means, said processing means selecting the second image transfer mode when the signal is transmitted to indicate that an available amount of energy in said energy source is less than the predetermined amount of energy.

26. Printer, characterised in that it includes an energy saving device for an image transfer system of the type having an energy source (37), means (15, 22, 36) for detecting a predetermined quantity of energy in said energy source adapted to transmit a signal representing that this predetermined quantity has been passed, and a printing head (13) comprising ink distribution means (42) controlled by control signals representing information to be printed, wherein said energy saving device includes control means (28) suitable for generating first control signals for a first operating mode having a first energy consumption and a first image quality and second control signals for a second operating mode having a second energy consumption and providing a second image quality, the second energy consumption and the second image quality being reduced with respect to the first ones, the second image transfer mode being one wherein edging processing is performed to reduce a total surface area of ink application as compared with the first image transfer mode by relatively emphasizing edge areas of an image relative to non-edge areas thereof, and a processing means (22) for selecting one of the operating modes according to the signal transmitted by said energy quantity detection means, said processing means selecting the second image transfer mode when the signal is transmitted to indicate that an available amount of energy in said energy source is less than the predetermined amount of energy.

27. Computer, characterised in that it includes a printer that in turn includes an energy saving device for an image transfer system of the type having an energy source (37), means (15, 22, 36) for detecting a predetermined quantity of energy in said energy source adapted to transmit a signal representing that this predetermined quantity has been passed, and a printing head (13) comprising ink distribution means (42) controlled by control signals representing information to be printed, wherein said energy saving device includes control means (28) suitable for generating first control signals for a first operating mode having a first energy consumption and a first image quality and second control signals for a second operating mode having a second energy consumption and providing a second image quality, the second energy consumption and the second image quality being reduced with respect to the first ones, the second image transfer mode being one wherein edging processing is performed to reduce a total surface area of ink application as compared with the first image transfer mode by relatively emphasizing edge areas of an image relative to non-edge areas thereof, and a processing means (22) for selecting one of the operating modes according to the signal transmitted by said energy quantity detection means, said processing means selecting the second image transfer mode when the signal is transmitted to indicate that an available amount of energy in said energy source is less than the predetermined amount of energy.

* * * * *